United States Patent [19]

Takada et al.

[11] Patent Number: 4,613,565

[45] **Date of Patent: * Sep. 23, 1986**

[54] SILVER HALIDE PHOTOGRAPHIC MATERIAL

[75] Inventors: Shun Takada; Takashi Kadowaki; Kaoru Onodera, all of Odawara, Japan

[73] Assignee: Konishiroku Photo Industry Co., Ltd., Japan

[ * ] Notice: The portion of the term of this patent subsequent to Aug. 27, 2002 has been disclaimed.

[21] Appl. No.: 724,576

[22] Filed: Apr. 18, 1985

[30] Foreign Application Priority Data

Apr. 19, 1984 [JP] Japan ..... 59-78888

[51] Int. Cl.[4] ..... G03C 7/32; G03C 7/34

[52] U.S. Cl. ..... 430/549; 430/552; 430/553; 430/558; 430/505

[58] Field of Search ..... 430/549, 552, 553, 558, 430/505

[56] References Cited

U.S. PATENT DOCUMENTS

| | | | |
|---|---|---|---|
| 4,427,767 | 1/1984 | Aoki et al. | 430/552 |
| 4,458,012 | 7/1984 | Ito et al. | 430/553 |
| 4,537,857 | 8/1985 | Takada et al. | 430/553 |

*Primary Examiner*—Mary F. Downey

*Attorney, Agent, or Firm*—Finnegan, Henderson, Farabow, Garrett & Dunner

[57] ABSTRACT

A silver halide photographic material having one or more silver halide emulsion layers formed on a support is disclosed, wherein at least one of said silver halide emulsion layers contains a cyan coupler of formula (I) in combination with a cyan coupler of formula (II):

(I)

(wherein $R_1$ is a ballast group; $R_2$ is a halogen atom or a monovalent organic group; $R_3$ is a hydrogen atom, a halogen atom, an alkyl group or an alkoxy group; W is an alkyl-sulfonamido group, an arylsulfonamido group, an alkylsulfamoyl group or an arylsulfamoyl group; m is an integer of 0 to 4, provided that when m is 2 or more, $R_2$ may be the same or different; and $Z_1$ is a hydrogen atom or a group capable of leaving upon reaction with the oxidized product of an aromatic primary amine color developing agent);

(II)

(wherein $R_4$ is an alkyl or alkoxy group; n is an integer of 0 to 5, provided that when n is 2 or more, $R_4$ may be the same or different; $R_5$ is an alkylene group; $R_6$ is an alkyl group; $R_7$ is a hydrogen atom, a halogen atom or an alkyl group; and $Z_2$ is a hydrogen atom or a group capable of leaving upon reaction with the oxidized product of an aromatic primary amine color developing agent).

8 Claims, No Drawings

SILVER HALIDE PHOTOGRAPHIC MATERIAL

FIELD OF THE INVENTION

The present invention relates to a silver halide photographic material. More particularly, the invention relates to a silver halide photographic material that contains cyan couplers having improved dissolvability and dispersion stability, which provides dye images having improved color reproduction and storage stability, and which can be manufactured with consistently good quality.

BACKGROUND OF THE INVENTION

The mechanism behind the formation of dye images in a silver halide color photographic material is that an aromatic primary amine developing agent, while reducing silver halide grains in the exposed photographic material, is oxidized and the resulting oxidized product reacts with a coupler already present in the silver halide color photographic material so as to form a dye. Color reproduction in this case depends commonly on the subtractive process using three couplers which respectively form yellow, magenta and cyan dyes. These couplers are added to silver halide emulsion layers after they are dissolved in a substantially water-soluble high-boiling organic solvent, optionally in combination with an auxiliary solvent.

There are several requirements that must be met by the couplers first, they must have high solubility in high-boiling organic solvents, and they should be highly dispersible in silver halide emulsions and the prepared dispersion should remain stable without causing the precipitation of the couplers; secondly, the couplers should have sufficiently good spectral absorption characteristics and color tone to produce sharp dye images over a broad color reproduction range; and thirdly, the couplers should produce dye images which are fast to light, heat and moisture.

Among the three dye-forming couplers, the cyan coupler is required to provide a cyan dye image having sufficient resistance to light, heat and moisture so that it can be stored in a well balanced manner in terms of deterioration resulting from light, heat and moisture. A particularly important requirement is that the cyan dye image has improved dark discoloration when exposed to heat and moisture.

Illustrative cyan couplers that satisfy these requirements are 2,5-diacylaminophenols having an acylamino group as a substituent on the 2- and 5-positions of the phenol ring, and cyan couplers of this type are shown in U.S. Pat. No. 2,895,826, as well as Japanese Unexamined Published Patent Application Nos. 112038/1975, 109630/1978 and 163537/1980.

Such 2,5-diacylaminophenolic cyan couplers produce cyan dye images having improved keeping quality, particularly in terms of dark discoloration. Additionally, the image has high stability in a processing solution, especially a bleach-fixing solution, and exhibits good recoloring properties.

However, these cyan couplers have the following disadvantages (1) they have a high minimum spectral density (hence, low brightness) in the region of 450–480 nm, thereby providing a small color reproduction range and, additionally, the high absorption in the 500–550 nm range causes poor reproduction of the green color; (2) the couplers do not have adequate resistance to light; and (3) the couplers are low in dissolvability and dispersion stability. Furthermore, the sensitivity of silver halides in a coating solution of a silver halide photographic emulsion which contains such 2,5-diacylaminophenolic cyan couplers (hereunder simply referred to as a coating solution) and which is immediately applied to the substrate after its preparation differs greatly from the sensitivity obtained when the coating solution is allowed to stand for a certain period after its preparation. This shortness of the period during which the sensitivity of silver halide grains remains the same has heretofore prevented the mass production of silver halide photographic materials having consistent quality.

The problem of the sensitivity variation following the preparation of an emulsion coating solution can be effectively solved by adding a sensitizing dye to the coating solution, but as more sensitizing dye is added, frequent dye staining occurs.

Other methods have been proposed for extending the period during which the silver halide sensitivity retains its initial high level they include (1) addition of a known stabilizer (e.g. azoles or azaindene compounds) to the coating solution; (2) adding a reducing agent (e.g. hydroquinones or sulfinic acids) to the coating solution; and (3) using a specific compolymer in combination with a brightener, as described in Japanese Unexamined Published Patent Application NO. 111629/1974. However, none of these methods are capable of attaining the intended object in a completely satisfactory manner, and some of them even cause adverse effects on important photographic properties such as tone gradation and sensitivity.

SUMMARY OF THE INVENTION

One object of the present invention, therefore, is to provide a silver halide photographic material containing a cyan coupler that has sufficiently good spectral absorption characteristics and color tone to produce a sharp dye image over a broad color reproduction range.

Another object of the present invention is to provide a silver halide photographic material capable of forming a dye image that is well balanced in its resistance to light, heat and moisture so as to enable extended storage.

Still another object of the present invention is to provide a silver halide photographic material containing a cyan coupler having improved dissolvability, dispersibility and dispersion stability.

A further object of the present invention is to provide a silver halide photographic material that is adapted to consistent mass production because of the long-term stability of the coating solution of a silver halide emulsion.

A silver halide photographic material according to the present invention contains one or more silver halide emulsion layers formed on a support, at least one of said silver halide emulsion layers containing a cyan coupler of formula (I) in combination with a cyan coupler of formula (II):

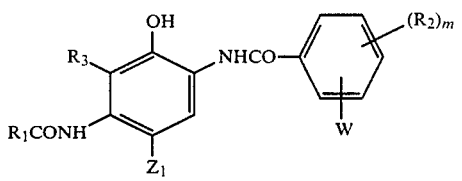

(I)

(wherein $R_1$ is a ballast group; $R_2$ is a halogen atom or a monovalent organic group; $R_3$ is a hydrogen atom, a halogen atom, an alkyl group or an alkoxy group; W is an alkylsulfonamido group, an arylsulfonamido group, an alkylsulfamoyl group or an arylsulfamoyl group; m is an integer of 0 to 4, provided that when m is 2 or more, $R_2$ may be the same or different; and $Z_1$ is a hydrogen atom or a group capable of leaving upon reaction with the oxidized product of an aromatic primary amine color developing agent);

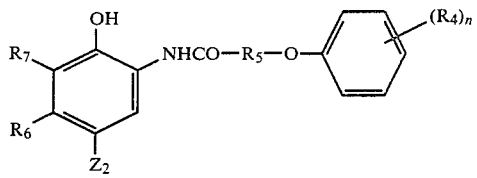

(II)

(wherein $R_4$ is an alkyl or alkoxy group; n is an integrer of 0 to 5, provided that when n is 2 or more, $R_4$ may be the same or different; $R_5$ is an alkylene group; $R_6$ is an alkyl group; $R_7$ is a hydrogen atom, a halogen atom or an alkyl group; and $Z_2$ is a hydrogen atom or a group capable of leaving upon reaction with the oxidized product of an aromatic primary amine color developing agent).

PREFERRED EMBODIMENTS OF THE INVENTION

In the present invention, the ballast group represented by $R_1$ in formula (I) is a group sufficient to prevent the cyan couplers from diffusion in the silver halide emulsion layer, and includes, for example, an alkyl group and an aryl group. Examples of the monovalent organic group represented by $R_2$ include a nitro group, an amino group, a cyano group, a hydroxy group, a carboxy group, an alkyl group having 1 to 20 carbon atoms (e.g. methyl, ethyl, propyl, isopropyl, t-butyl or octyl), an aralkyl group (e.g benzyl or phenetyl), an alkoxy group (e.g. methoxy, ethoxy or benzyloxy), an aryloxy group (e.g. phenoxy or p-nitrophenoxy), an acylamino group (e.g. acetylamino, propionylamino, benzoylamino or phenoxyacetylamino), a carbamoyl group (e.g. methylcarbamoyl, dimethylcarbamoyl, phenylcarbamoyl or diphenylcarbamoyl), a sulsonamido group (e.g. methanesulfonamido, butanesulfonamido, benzenesulfonamido or p-toluenesulfonamido), a sulfamoyl group (e.g. methylsulfamoyl, dimethylsulfamoyl or phenylsulfamoyl), an alkylcarbonyl group (e.g. methylcarbonyl, propylcarbonyl or octylcarbonyl), an arylcarbonyl group (e.g. phenylcarbonyl), an alkyloxycarbonyl group (e.g. methyloxycarbonyl, ethyloxycarbonyl, butyloxycarbonyl or t-butyloxycarbonyl), an aryloxycarbonyl group (e.g. phenyloxycarbonyl or methoxyphenyloxycarbonyl), an alkylsulfonyl group (e.g. methanesulfonyl or butanesulfonyl) and an arylsulfonyl group (e.g. benzenesulfonyl). In the present invention, the cyan coupler represented by formula (I) is preferably a compound represented by the following formula (III):

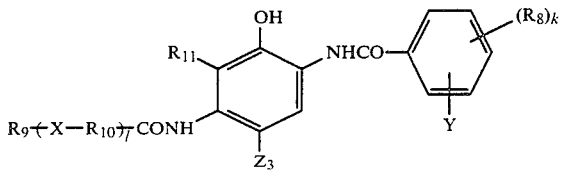

(III)

wherein Y is represented by

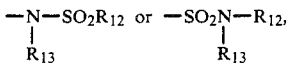

wherein $R_{12}$ is an alkyl group or an aryl group, either of which may have a substituent; $R_{13}$ is a hydrogen atom, an alkyl group or an aryl group, and each of the latter two groups may have a substituent. Examples of the substituent in the alkyl or aryl group represented by $R_{12}$ and $R_{13}$ include a halogen atom (e.g. chlorine, bromine or fluorine), an alkyl group (e.g. methyl, ethyl, propyl, butyl or octyl), a polyfluoroalkyl group, a hydroxyl group, a carboxyl group, a cyano group, a nitro group, an alkoxy group (e.g. methoxy or ethoxy), an alkylsulfonamido group (e.g. methylsulfonamido or octylsulfonamido), an arylsulfonamido group (e.g. phenylsulfonamido or naphthylsulfonamido), an alkylsulfamoyl group (e.g. butylsulfamoyl), an arylsulfamoyl group (e.g. phenylsulfamoyl), an alkyloxycarbonyl group (e.g. methyloxycarbonyl), an aryloxycarbonyl group (e.g. phenyloxycarbonyl), an alkylcarbonyl (e.g. acetyl), an arylcarbonyl (e.g. phenylcarbonyl), an acyloxy group, a carbamoyl group (e.g. ethylcarbamoyl), an acylamino group, a ureido group, an anilino group, and a mercapto group. Preferred groups represented by $R_{12}$ are methyl, ethyl, butyl, octyl, dodecyl, phenyl, and ethylphenyl. Preferred examples of $R_{13}$ are hydrogen, methyl, ethyl and butyl $R_8$ in formula (III) is a halogen atom (e.g. fluorine, chlorine or bromine), an alkyl group having 1 to 22 carbon atoms (e.g. methyl, ethyl, or butyl) and a polyfluoroalkyl group or an alkoxy group (e.g. methoxy or ethoxy).

k in formula (III) is an integer of 0 to 4, provided that when k is 2 or more, $R_8$ may be the same or different.

$R_9$ is an alkyl group or an aryl group, either which groups may have one or more substituents. Typical substituents include a halogen atom (e.g. fluorine, chlorine or bromine), a hydroxyl group, a carboxy group, an alkyl group (e.g. methyl, ethyl, propyl, butyl, octyl or dodecyl), an aralkyl group, a cyano group, a nitro group, an alkoxy group (e.g. methoxy or ethoxy), an aryloxy group, an alkylsulfonamido group (e.g. methylsulfonamido or octylsulfonamido), an arylsulfonamido group (e.g. phenylsulfonamido or naphthylsulfonamido), an alkylsulfamoyl group (e.g. butylsulfamoyl), an arylsulfamoyl group (e.g. phenylsulfamoyl), an alkyloxycarbonyl group (e.g. methyloxycarbonyl), an aryloxycarbonyl group (e.g. phenyloxycarbonyl), an aminosulfonamido group (e.g. dimethylaminosulfonamido), an alkylsulfonyl group, an arylsulfonyl group, an alkylcarbonyl group, an arylcarbonyl group, an aminocarbonylamido group, a carbamoyl group and a sulfinyl group. $R_9$ may have two or more of these substituents. A preferred group represented by $R_9$ is an alkyl group when l is 0, or an aryl group when l is 1 or more. A more preferable group represented by $R_9$ is an alkyl group having 1 to 22 carbon atoms when l is 0 (e.g. methyl, ethyl, propyl, butyl, octyl or dodecyl), or a phenyl group or a phenyl group having as one or more substituents an alkyl group (e.g. t-butyl, t-amyl, or octyl), an alkylsulfonamido group (e.g. butylsulfonamido, octylsulfonamido or dodecylsulfonamido), an aminosulfonamido (e.g. dimethylaminosulfonamido), or an alkyloxycarbonyl group (e.g. methyloxycarbonyl or butyloxycarbonyl) when l is 1 or more.

The alkylene group represented by $R_{10}$ in formula (III) is preferably a straight-chain or branched-chain alkylene group having 1-20, more preferably 1-12 carbon atoms.

$R_{11}$ is a hydrogen atom or a halogen atom (fluorine, bromine or iodine), preferably a hydrogen atom.

l is 0 or a positive integer, preferably 0 or 1.

Examples of the divalent group represented by X in formula (III) include —O—, —CO—, —COO—, —OCO—, $—SO_2NR'—$, $—NR'SO_2NR''$, —S—, —SO— and $—SO_2—$, wherein R' and R'' each represent an alkyl group which may have a substituent.

Preferred examples of X are —O—, —S—, —SO— and $—SO_2—$.

The symbol $Z_3$ in formula (III) represents a hydrogen atom or a group capable of leaving upon reaction with the oxidized product of an aromatic primary amine color developing agent. Examples of the leaving group include a halogen atom (e.g. chlorine, bromine or fluorine), and groups having an oxygen, sulfur or nitrogen atom directly bound to the coupling site, such as alkoxy, aryloxy, sulfonylalkoxy, carbamoyloxy, carbamoylmethoxy, acyloxy, sulfonamido, triazolylthio, tetrazolylthio, tetrazolyl, carbonyloxy and succinimido.

Specific examples of the groups listed above are described in many prior art references such as U.S. Pat. Nos. 3,476,563, 3,227,554; Japanese Unexamined Published Patent Application No. 37425/1972, Japanese Patent Publication No. 36894/1973, Japanese Unexamined Published Patent Application Nos. 10135/1975, 117422/1975, 130441/1975, 108841/1976, 120334/1975, 18315/1977, 52423/1978, 105226/1978, 14736/1979, 48237/1979, 32071/1980, 65957/1980, 1938/1981, 12643/1981, and 27147/1981.

Preferred examples of $Z_1$ are chlorine and fluorine atoms. In formula (III), Y represented by $$-\underset{\underset{R_{13}}{|}}{N}-SO_2R_{12} \text{ or } -SO_2-\underset{\underset{R_{13}}{|}}{N}-R_{12}$$

is preferably substituted on the ortho- or para-position of the benzen ring with respect to —NHCO-bonded to said benzen ring, more preferably substituted on the ortho-position.

Typical examples of the cyan couplers having the formula (I) are listed below:

(I-1)

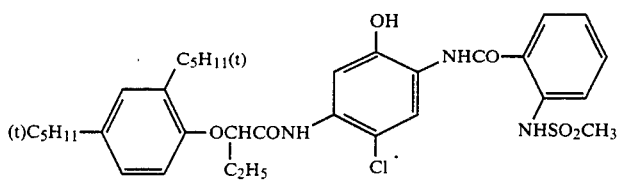

(I-2)

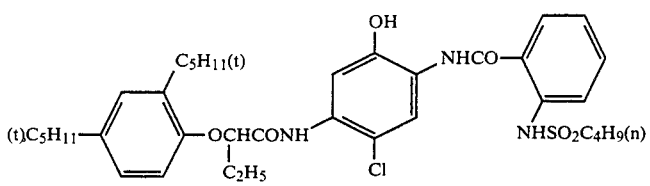

(I-3)

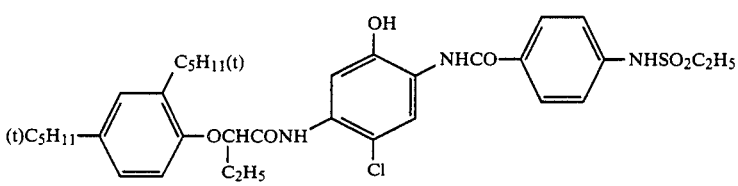

(I-4)

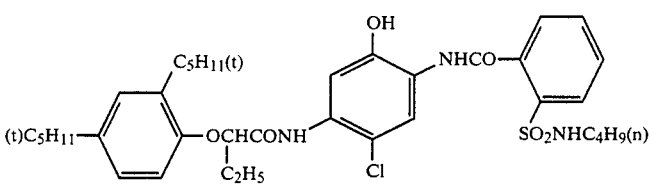

-continued
(I-5)
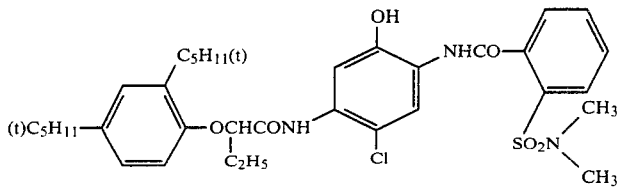
(I-6)
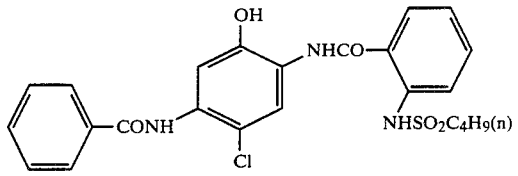
(I-7)
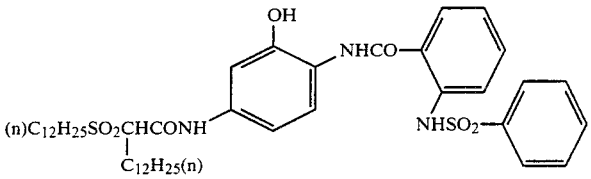
(I-8)
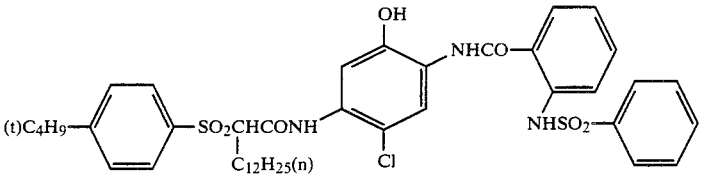
(I-9)
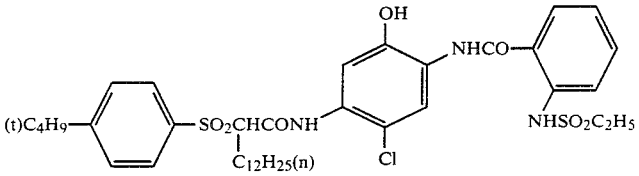
(I-10)
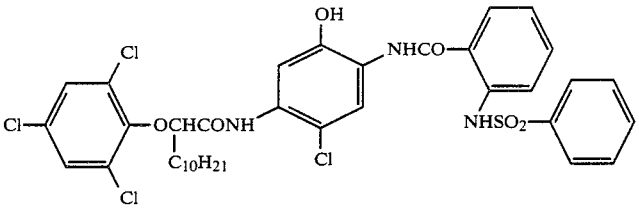
(I-11)
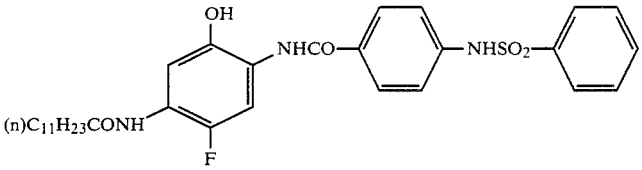

-continued
(I-12)
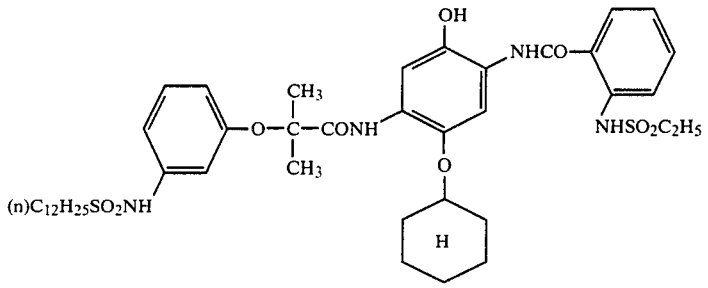
(I-13)
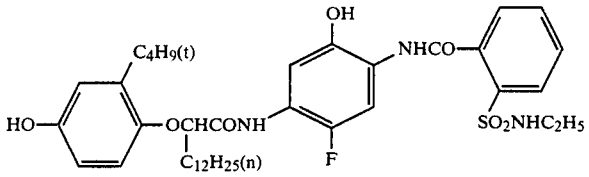
(I-14)
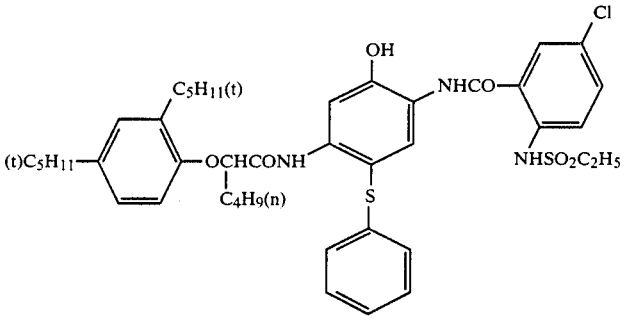
(I-15)
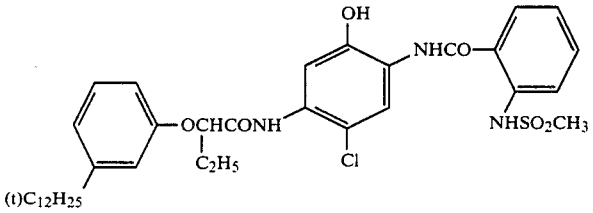
(I-16)
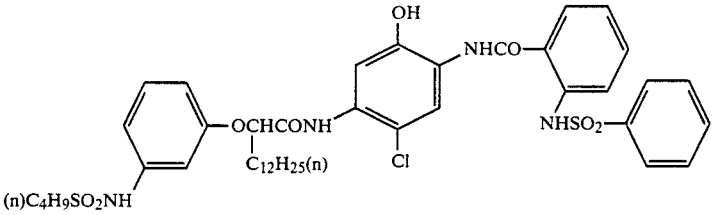
(I-17)
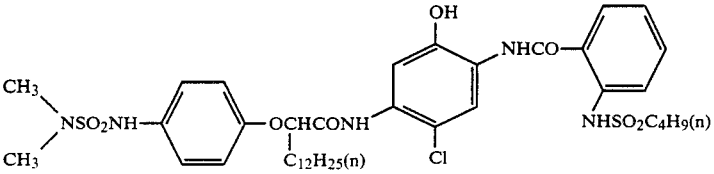
(I-18)
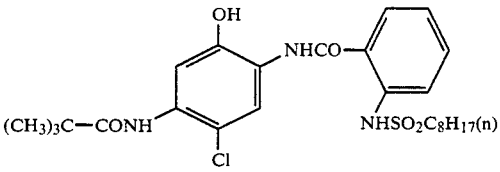

-continued
(I-19)
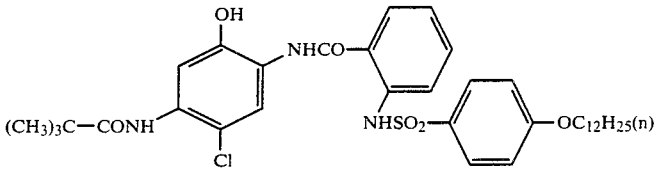
(I-20)
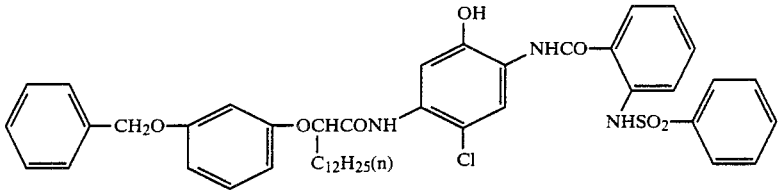
(I-21)
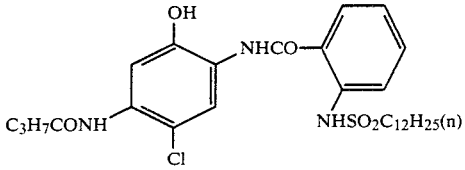
(I-22)
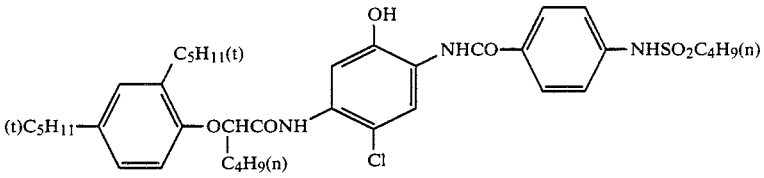
(I-23)
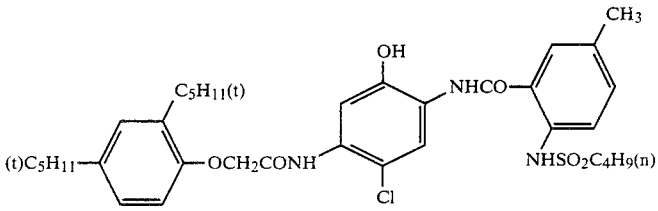
(I-24)
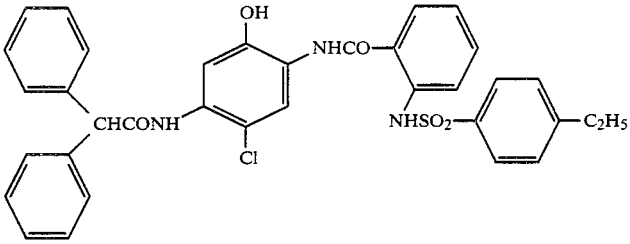
(I-25)
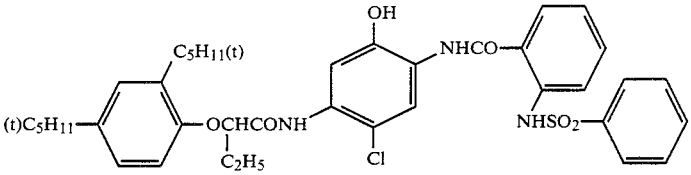

-continued (I-26)

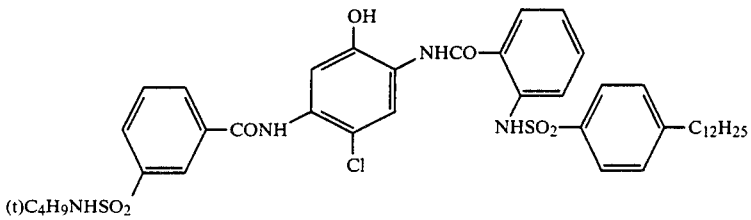

(I-27)

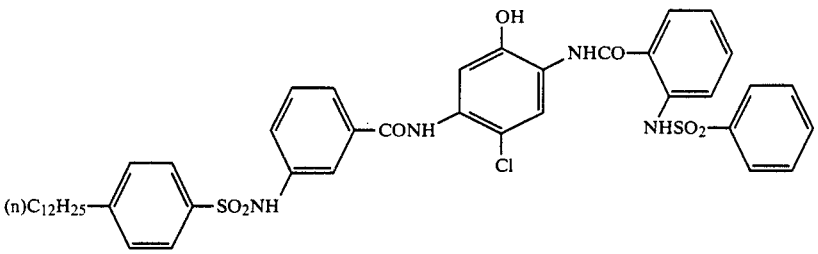

(I-28)

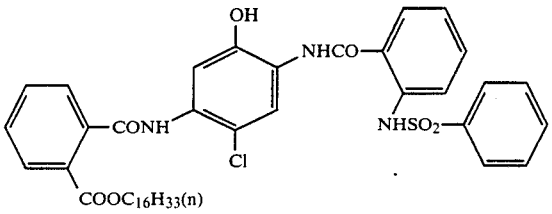

(I-29)

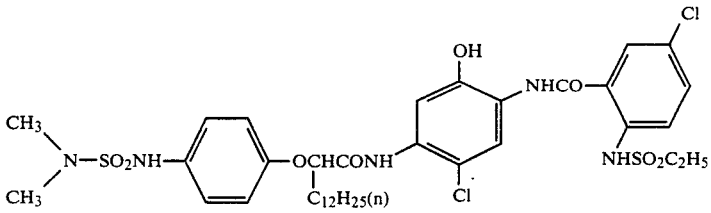

(I-30)

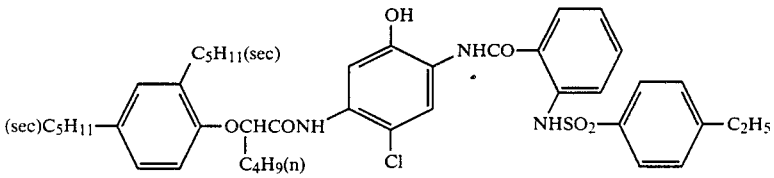

The symbol $R_4$ in the formula (II) representing the other cyan coupler used in the present invention is an alkyl group or an alkoxy group, and an alkyl group (e.g. butyl or amyl) is preferred.

The symbol $R_5$ in formula (II) represents an alkylene group, preferably a straight- or branched-chain alkylene group of 1 to 20 carbon atoms, with an alkylene group of 1 to 12 carbon atoms being particularly preferred.

The symbol $R_6$ in formula (II) is an alkyl group, with a methyl group being preferred.

The symbol $R_7$ in formula (II) represents a hydrogen atom, a halogen atom or an alkyl group, with a halogen atom being preferred. A preferred halogen is chlorine.

The symbol $Z_2$ in formula (II) includes the groups listed in the definition of Z in formula (III), with a halogen atom being preferred. A preferred halogen is chlorine.

Typical examples of the cyan coupler represented by formula (II) are listed below.

(II-1)

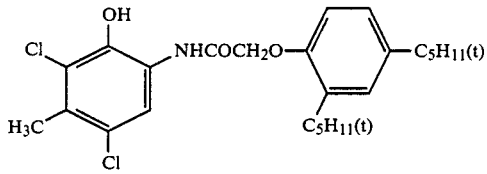

(II-2)

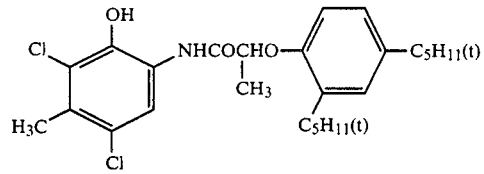

-continued
(II-3)
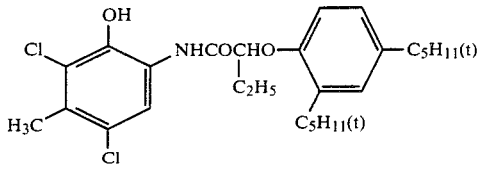
(II-4)
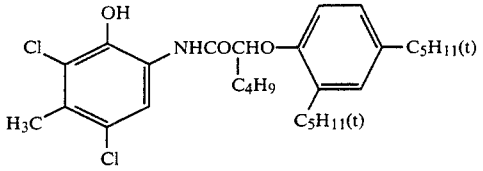
(II-5)
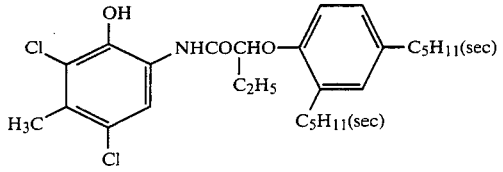
(II-6)
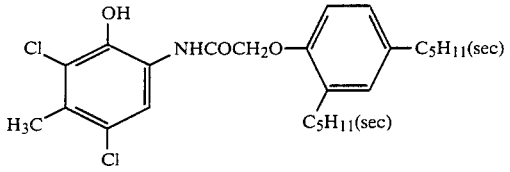
(II-7)
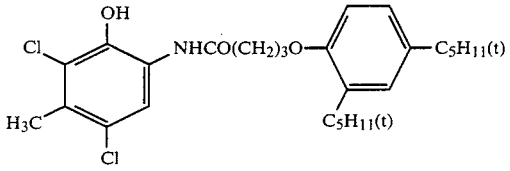
(II-8)
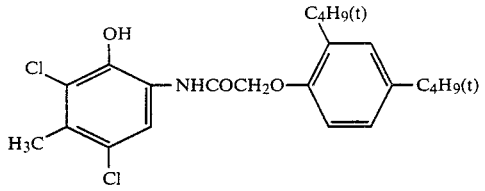
(II-9)
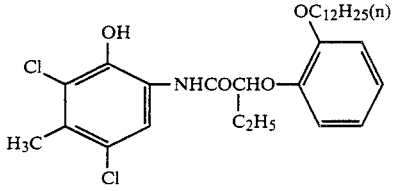
(II-10)
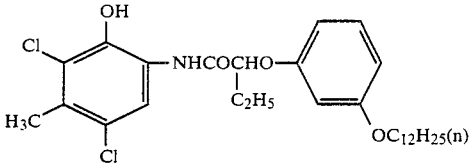
-continued
(II-11)
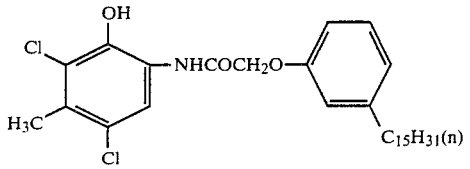
(II-12)
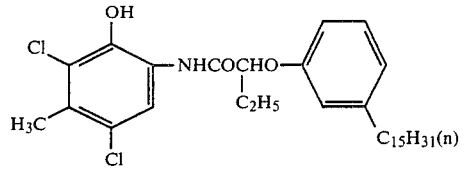
(II-13)
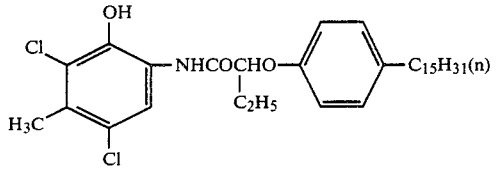
(II-14)
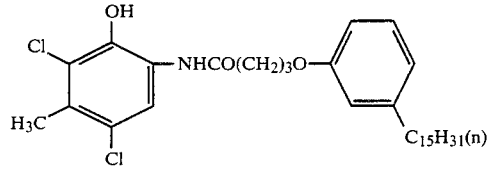
(II-15)
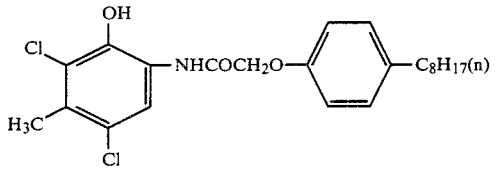
(II-16)
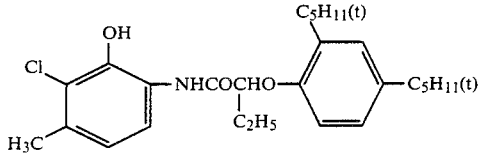
(II-17)
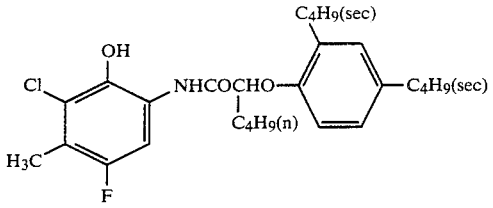
(II-18)
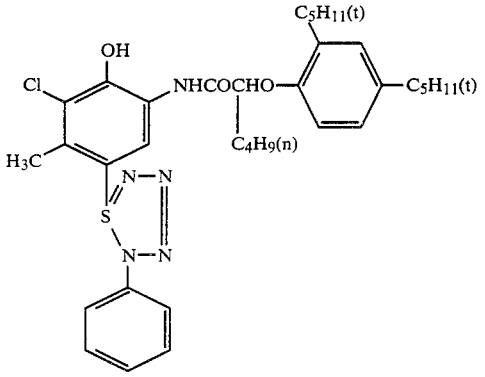

-continued (II-19)

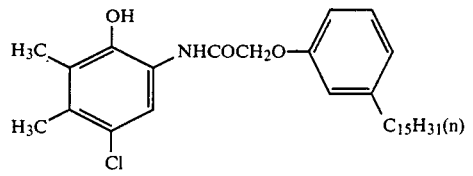

(II-20)

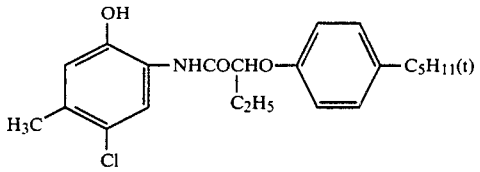

At least one of the cyan couplers of formula (I) may be combined with at least one of the cyan couplers of formula (II) in desired proportions and in desired manners. Preferably, the cyan coupler of formula (I) accounts for 30–95 mol % of the total amount of the cyan couplers, and the range of 50–90 mol % is particularly preferred.

The silver halide photographic material of the present invention may assume any number of the silver halide emulsion layers and non-sensitive layers that may be arranged in any order so long as at least one silver halide emulsion layer is disposed on a support. Typical applications of the silver halide photographic material of the present invention are as color positive or negative films, color papers, color slides, and as sensitive materials for such special purposes as printing, radiography and high-resolution photography. Particularly advantageous applications are as color papers. Usually, most of the silver halide emulsion layers and non-sensitive layers are formed as hydrophilic colloidal layers containing hydrophilic binders. Preferred hydrophilic binders include gelatin, and gelatin derivatives such as acylated gelatin, guanidylated gelatin, carbamylated gelatin, cyanoethanolated gelatin and esterified gelatin.

The cyan couplers of formula (I) and (II) in accordance with the present invention (such couplers are hereunder simply referred to as the cyan couplers of the present invention) may be processed by techniques that are commonly used with conventional cyan-dye forming couplers; silver halide emulsion layers containing the cyan couplers of the present invention are coated onto a support for providing a photographic element. This photographic element may be monochromatic or multi-colored. In the latter case, the cyan couplers of the present invention are usually incorporated in red-sensitive silver halide emulsion layers, but they may be present in non-sensitized emulsions or emulsion layers having sensitivity to the three spectral primary colors other than red. Each of the units in the photographic element for forming dye images in accordance with the present invention is either a single-layered or multilayered emulsion layer having sensitivity to a certain range in the spectrum.

The cyan couplers of the present invention may be incorporated in emulsions by any of the known methods. For example, the cyan couplers used either singly or in combination are dissolved in high-boiling organic solvents such as phthalate esters (e.g. dibutyl phthalate), phosphate esters (e.g. tricresyl phosphate) or N,N-dialkyl substituted amides (e.g. N,N-diethyllaurylamide) and low-boiling organic solvents such as butyl acetate or butyl propionate. Such organic solvents may be used either singly or in combination as required. The resulting solution is mixed with aqueous gelatin containing a surfactant, and the mixture is dispersed by a suitable means such as a high-speed rotary mixer, a colloid mill or an ultrasonic disperser. Thereafter, the dispersion is added to a suitable silver halide so as to prepare the desired silver halide emulsion.

The cyan couplers of the present invention are usually incorporated in the silver halide emulsion in an amount of about 0.05–2 mols per mol of the silver halide, with the range of 0.1–1 mol being preferred.

In order to make a multi-colored photographic element from the silver halide photographic material of the present invention, the necessary layers including the image-forming units may be arranged in various orders as are well known in the art. A typical multi-colored photographic element is such that a cyan dye image forming unit comprised of at least one red-sensitive silver halide emulsion layer containing one or more cyan dye forming couplers (at least one of the cyan dye forming couplers must be the cyan coupler of formula (I) and at least one other coupler must be the cyan coupler of formula (II)), a magenta dye image forming unit comprised of at least one green-sensitive silver halide emulsion layer containing at least one magenta dye forming coupler, and a yellow dye image forming unit comprised of at least one blue-sensitive silver halide emulsion layer containing at least one yellow dye forming coupler are carried on a support.

The photographic element may contain additional non-sensitive layers such as a filter layer, an intermediate layer, a protective layer, an anti-halation layer and a subbing layer.

Preferred compounds for use as the yellow dye forming coupler in the present invention have the following formula (IV):

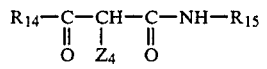

(IV)

wherein $R_{14}$ is an alkyl group (e.g. methyl, ethyl, propyl or butyl), or an aryl group (e.g. phenyl or p-methoxyphenyl); $R_{15}$ is an aryl group; and $Z_4$ is a hydrogen atom or a group that leaves during color delopment reaction.

Particularly preferred compounds that can be used as the yellow dye image forming coupler have the following formula (IV'):

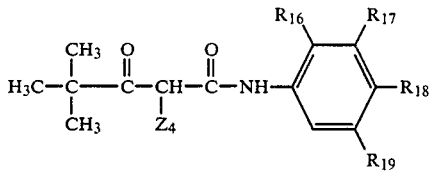

(IV')

wherein $R_{16}$ is a halogen atom, an alkoxy or an aryloxy group; $R_{17}$, $R_{18}$ and $R_{19}$ each represents a hydrogen atom, a halogen atom, an alkyl, alkenyl, alkoxy, aryl, aryloxy, carbonyl, sulfonyl, carboxyl, alkoxycarbonyl, carbamyl, sulfon, sulfamyl, sulfonamido, acylamido, ureido or amino group; $Z_4$ has the same meaning as that of $Z_4$in formula (IV).

These yellow dye image forming couplers are shown in many prior art references such as U.S. Pat. Nos.

2,778,658, 2,875,057, 2,908,573, 3,227,155, 3,227,550, 3,253,924, 3,265,506, 3,277,155, 3,341,331, 3,369,895, 3,384,657, 3,408,194, 3,415,652, 3,447,928, 3,551,155, 3,582,322, 3,725,072, and 3,894,875; German Patent Application (OLS) Nos. 1,547,868, 2,057,941, 2,162,899, 2,163,812, 2,213,461, 2,219,917, 2,261,361 and 2,263,875; Japanese Patent Publication No. 13576/1974; as well as Japanese Unexamined Published Patent Application Nos. 29432/1973, 66834/1973, 10736/1974, 122335/1974, 28834/1975 and 132926/1975.

Compounds preferred for use as the magenta dye image forming coupler have the following formula (V):

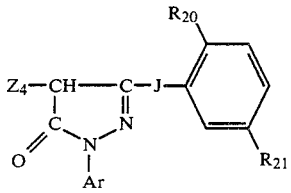

(V)

wherein Ar is an aryl group; $R_{20}$ is a hydrogen atom, a halogen atom, an alkyl group or an alkoxy group; $R_{21}$ is an alkyl, amido, imido, N-alkylcarbamoyl, N-alkylsulfamoyl, alkoxycarbonyl, acyloxy, sulfonamido or urethane group; $Z_4$ is the same as defined for formula (IV); and J is —NH—, —NHCO— (the N atom being bound to a carbon atom in the pyrazolone nucleus) or —NHCONH—.

These magenta dye image forming couplers are shown in many prior art references such as U.S. Pat. Nos. 2,600,788, 3,061,432, 3,062,653, 3,127,269, 3,311,476, 3,152,896, 3,419,391, 3,519,429, 3,555,318, 3,684,514, 3,888,680, 3,907,571, 3,928,044, 3,930,861, 3,930,866 and 3,933,500; Japanese Unexamined Published Patent Application Nos. 29639/1974, 111631/1974, 129538/1974, 13041/1975, 58922/1977, 62454/1980, 118034/1980 and 38043/1981; British Patent No. 1,247,493; Belgian Patent Nos. 769,116 and 792,525; West German Patent No. 2,156,111; and Japanese Patent Publication No. 60479/1971.

Typical examples of the yellow and magenta dye forming couplers that may be preferably used in the present invention are listed below Yellow couplers:

(Y-1)

α-Benzoyl-2-chloro-5-[α-(dodecyloxycarbonyl)-ethoxycarbonyl]acetanilide.

(Y-2)

α-Benzoyl-2-chloro-5-[γ-(2,4-di-t-amylphenoxy)-butylamido]-acetanilide.

(Y-3)

α-Fluoro-α-pivalyl-2-chloro-5-[γ-(2,4-di-t-amylphenoxy)butylamido]-acetanilide.

(Y-4)

α-Pivalyl-α-stearoyloxy-4-sulfamoyl-acetanilide.

(Y-5)

α-Pivalyl-α-[4-(4-benzyloxyphenylsulfonyl)-phenoxy]-2-chloro-5-[γ-(2,4-di-t-amylphenoxy)-butylamido]acetanilide.

(Y-6)

α-(2-Methoxybenzoyl)-α-(4-acetoxyphenoxy)-4-chloro-2-(4-t-octylphenoxy)-acetanilie.

(Y-7)

α-Pivalyl-α-(3,3-dipropyl-2,4-dioxo-acetidin-1-yl)-2-chloro-5-[α-(dodecyloxycarbonyl)-ethoxycarbonyl]-acetanilide.

(Y-8)

α-Pivalyl-α-succinimido-2-chloro-5-[γ-(2,4-di-t-amylphenoxy)butylamido]acetanilide.

(Y-9)

α-Pivalyl-α-(3-tetradecyl-1-succinimido)acetanilide.

(Y-10)

α-(4-Dodecyloxybenzoyl)-α-(3-methoxy-1-succinimido)-3,5-dicarboxyacetanilide dipotassium salt.

(Y-11)

α-Pivalyl-α-phthalimido-2-chloro-5-[γ-(2,4-di-tamylphenoxy)butylamido]acetanilide.

(Y-12)

α-2-Furyl-α-phthalimido-2-chloro-5-[γ-(2,4-di-t-amylphenoxy)butylamido]acetanilide.

(Y-13)

α-3-[α-(2,4-di-t-amylphenoxy)butylamido]-benzoyl-α-succinimido-2-methoxyacetanilide.

(Y-14)

α-Phthalimido-α-pivalyl-2-methoxy-4-[(N-methyl-N-octadecyl)sulfamoyl]-acetanilide.

(Y-15)

α-Acetyl-α-succinimido-2-methoxy-4-[(N-methyl-N-octadecyl)sulfamoyl]-acetanilide.

(Y-16)

α-Cyclobutyryl-α-(3-methyl-3-ethyl-1-succinimido)-2-chloro-5-[(2,5-di-t-amylphenoxy)acetamido]acetanilide.

(Y-17)

α-(3-Octadecyl-1-succinimido)-α-propenoyl-acetanilide.

(Y-18)

α-(2,6-Di-oxo-3-n-propyl-piperidine-1-yl)-α-pivalyl-2-chloro-5-[γ-(2,4-di-t-amylphenoxy)butylcarbamoyl-]acetanilide.

(Y-19)

α-(1-Benzyl-2,4-dioxo-imidazolidine-3-yl)-α-pivalyl-2-chloro-5-[γ-(2,4-di-t-amylphenoxy)-butylamido]acetanilide.

(Y-20)

α-(1-Benzyl-2-phenyl-3,5-dioxo-1,2,4-triazine-4-yl)-α-pivalyl-2-chloro-5-[γ-(2,4-di-t-amylphenoxy)-butylamido]-acetanilide.

(Y-21)

α-(3,3-Dimethyl-1-succinimido)-α-pivalyl-2-chloro-5[α-(2,4-di-t-amylphenoxy)butylamido]acetanilide.

(Y-22)

α-[3-(p-Chlorophenyl)-4,4-dimethyl-2,5-dioxo-1-imidazolyl]-α-pivalyl-2-chloro-5-[γ-(2,4-di-t-amylphenoxy)-butylamido]-acetanilide.

(Y-23)

α-Pivalyl-α-(2,5-dioxo-1,3,4-triazine-1-yl)-2-methoxy-5-[α-(2,4-di-t-amylphenoxy)-butylamido]-acetanilide.

(Y-24)

α-(5-Benzyl-2,4-dioxo-3-oxazoyl)-α-pivalyl-2-chloro-5-[γ-(2,4-di-t-amylphenoxy)-butylamido]-acetanilide.

(Y-25)

α-(5,5-Dimethyl-2,4-dioxo-3-oxazoyl)-α-pivalyl-2-chloro-5-[α-(2,4-di-t-amylphenoxy)butylamido]-acetanilide.

(Y-26)

α-(3,5-Dioxo-4-oxazinyl)-α-Pivalyl-2-chloro-5-[γ-(2,4-di-t-amylphenoxy)-butylamido]-acetanilide.

(Y-27)

α-Pivalyl-α-(2,4-dioxo-5-methyl-3-thiazolyl)-2-chloro-5-[γ-(2,4-di-t-amylphenoxy)-butylamido]-acetanilide.

(Y-28)

α-[3(2H)-pyridazone-2-yl]-α-pivalyl-2-chloro-5-[γ-(2,4-di-t-amyl-phenoxy)-butylamido]-acetanilide.

(Y-29)

α-[4,5-Dichloro-3(2H)-pyridazone-2-yl]-α-benzoyl-2-chloro-5-[α-(dodecyloxycarbonyl)-ethoxycarbonyl]-acetanilide.

(Y-30)

α-(1-Phenyl-tetrazole-5-oxy)-α-pivalyl-2-chloro-5-[γ-(2,4-di-t-amylphenoxy)-butylamido]-acetanilide.

(Y-31)

4,4'-Di-(acetoacetoamino)-3,3-dimethyldiphenylmethane.

(Y-32)

P,P'-Di-(acetoacetoamino)diphenylmethane.

Magenta couplers (M-1)

1-(2,4,6-Trichlorophenyl)-3-(2-chloro-5-octadecylcarbamoylanilino)-5-pyrazolone.

(M-2)

1-(2,4,6-Trichlorophenyl)-3-(2-chloro-5-tetradecaneamidoanilino)-5-pyrazolone.

(M-3)

1-(2,4,6-Trichlorophenyl)-3-[2-chloro-5-γ-(2,4-di-t-amylphenoxy)-butylcarbamoyl]-anilino-5-pyrazolone.

(M-4)

1-(2,4,6-Trichlorophenyl)-4-chloro-3-[2-chloro-5-γ-(2,4-di-t-amylphenoxy)butylcarbamoyl]-anilino-5-pyrazolone.

(M-5)

1-(2,4,6-Trichlorophenyl)-4-diphenylmethyl-3-[2-chloro-5-(γ-octadecenylsuccinimido)-propylsulfamoyl]-anilino-5-pyrazolone.

(M-6)

1-(2,4,6-Trichlorophenyl)-4-acetoxy-5-(2-chloro-5-tetracecaneamido)-anilino-5-pyrazolone.

(M-7)

1-[γ-(3-Pentadecylphenoxy)-butylamido]-phenyl-3-anilino-4-(1-phenyl-tetrazole-5-thio)-5-pyrazolone.

(M-8)

1-(2,4,6-Trichlorophenyl)-3-(2-chloro-5-octadecylsuccinimido)-anilino-5-pyrazolone.

(M-9)

1-(2,4,6-Trichlorophenyl)-3-(2-chloro-5-octadecenylsuccinimido)-anilino-5-pyrazolone.

(M-10)

1-(2,4,6-Trichlorophenyl)-3-[2-chloro-5-(N-phenyl-N-octylcarbamoyl)]-anilino-5-pyrazolone.

(M-11)

1-(2,4,6-Trichlorophenyl)-3-[2-chloro-5-(N-butylcarbonyl)-pyrazinylcarbonyl]-anilino-5-pyrazolone.

(M-12)

1-(2,4,6-Trichlorophenyl)-3-[2-chloro-5-(2,4-di-carboxy-5-phenylcarbamoyl)-benzylamido]-anilino-5-pyrazolone.

(M-13)

1-(2,4,6-Trichlorophenyl)-3-(4-tetradecylthiomethylsuccinimido)-anilino-5-pyrazolone.

(M-14)

1-(2,4,6-Trichlorophenyl)-3-[2-chloro-4-(2-benzofurylcarboxyamido)]-anilino-5-pyrazolone.

(M-15)

1-(2,4,6-Trichlorophenyl)-3-{2-chloro-4-[γ-(2,2-dimethyl-6-octadecyl-7-hydroxy-chroman-4-yl)-propionamido]}-anilino-5-pyrazolone.

(M-16)

1-(2,4,6-Trichlorophenyl)-3-[2-chloro-5-(3-pentadecylphenyl)-phenylcarbonylamido]-anilino-5-pyrazolone.

(M-17)

1-(2,4,6-Trichlorophenyl)-3-{2-chloro-5-[2-(3-t-butyl-4-hydroxyphenoxy)-tetradecaneamido]-anilino}-5-pyrazolone.

(M-18)

1-(2,6-Dichloro-4-methoxyphenyl)-3-(2-methyl-5-tetradecaneamide)-anilino-5-pyrazolone.

(M-19)

4,4'-Benzylidenebis[1-(2,4,6-trichlorophenyl)-3-{2-chloro-4-[γ-(2,4-di-t-amylphenoxy)-butylamido]-anilino}-5-pyrazolone].

(M-20)

4,4'-Benzylidenebis[1-(2,3,4,5,6-pentachlorophenyl)-3-2-chloro-5-[γ-(2,4-di-t-amylphenoxy)-butylamido]-anilino-5pyrazolone].

(M-21)

4,4'-(2-Chloro)benzylidenebis[1-(2,4,6-trichlorophenyl)-3-(2-chloro-5-dodecylsuccinimido)-anilino-5-pyrazolone].

(M-22)

4,4'-Benzylidenebis[1-(2-chlorophenyl)-3-(2-methoxy-4-hexadecaneamido)-anilino-5-pyrazolone].

(M-23)

4,4'-Methylenebis[1-(2,4,6-trichlorophenyl)-3-(2-chloro-5-dodecenylsuccinimido)-anilino-5-pyrazolone)].

(M-24)

1-(2,4,6-Trichlorophenyl)-3-[3-(2,4-di-t-amylphenoxyacetamido)benzamido]-5-pyrazolone.

(M-25)

3-Ethoxy-1-4-[α-(3-pentadecylphenoxy)butylamido]-phenyl-5-pyrazolone.

(M-26)

1-(2,4,6-Trichlorophenyl)-3-[2-chloro-5-{α-(3-t-butyl-4-hydroxy)-phenyl}-tetradecaneamide]-anilino-5-pyrazolone.

(M-27)

1-(2,4,6-Trichlorophenyl)-3-3-nitroanilino-5-pyrazolone.

Each of these yellow and magenta dye forming couplers is incorporated in a silver halide emulsion layer in an amount of about 0.05 - 2 mols per mol of silver halide.

Examples of the support that can be used in the present invention include baryta paper, polyethylene coated paper, synthetic polypropylene paper; a transparent support with a reflective layer or a reflector; a glass sheet; a polyester film such as made of cellulose acetate, cellulose nitrate or polyethylene terephthalate; a polyamide film; a polycarbonate film; and a polystyrene film. A suitable support is properly selected depending upon the specific use of the silver halide photographic material prepared according to the present invention.

The silver halide emulsion layers and non-sensitive layers used in the present invention may be formed by any of the coating techniques including dip coating, air doctor coating, curtain coating and hopper coating.

Each of the silver halide emulsion layers according to the present invention may have incorporated therein any of the silver halides that are commonly employed in silver halide photographic materials, such as silver bromide, silver chloride, silver iodobromide, silver chlorobromide and silver chloroiodobromide. These silver halides may be used either as coarse or as fine grains, and the grain size distribution may be normal crystals or twins, with the proportions of (100) and (111) planes being selected at suitable values. The crystals of the silver halide grains may have a homogeneous internal structure, or they may have different internal and surface structures. The silver halides may be of such a type that a latent image is principally formed on the surface or of such a type that the image is formed within the grain. Such silver halide grains may be prepared by either the neutral method, ammoniacal method or the acid method. Silver halide grains prepared by the double-jet method, single-jet method (eigher normal or reverse) or the conversion method. Illustrative sulfur sensitizers are arylthiocarbamide, thiourea, and cystine. Selenium sensitizers may be activated or inactive. Exemplary reduction sensitizers are stannous salts and polyamines. Usable noble metal sensitizers include gold sensitizers (e.g. potassium aurithiocyanate, potassium chloroaurate, and 2-aurosulfobenzothiazole methyl chloride) and water-soluble palladium, platinum, ruthenium, rhodium or iridium salts (e.g. ammonium chloropalladate, potassium chloroplatinate and sodium chloropalladide). These chemical sensitizers may be used either singly or in combination.

The silver halide emulsions according to the present invention may contain various known photographic additives, such as those described in Research Disclosure No. 17643, December 1978.

The silver halides according to the present invention are spectrally sensitized with a suitable sensitizer in order to provide the red-sensitive emulsion with the necessary sensitivity in the proper spectral region. Various spectral sensitizers may be used either alone or in combination. Typical spectral sensitizers that can be used in the present invention with advantage are cyanine, merocyanine and composite cyanine dyes of the type shown in U.S. Pat. Nos. 2,270,378, 2,442,710 and 2,454,620.

The silver halide emulsion layers and non-sensitive layers in the silver halide color photographic material of the present invention may contain various other photographic additives such as antifoggants, anti-stain agents, brighteners, antistats, hardeners, plasticizers, wetting agents and UV absorbers, which are described in Research Disclosure No. 17643.

The silver halide photographic material thus prepared according to the present invention is exposed and subsequently processed photographically by various techniques of color development. The color developer preferred for use in the present invention contains an aromatic primary amine compound as the principal color developing agent. Typical color developing agents are p-phenylenediamine compounds, such as diethyl-p-phenylenediamine hydrochloride, monomethyl-p-phenylenediamine hydrochloride, dimethyl-p-phenylenediamine hydrochloride, 2-amino-5-diethylaminotoluene hydrochloride, 2-amino-5-(N-ethyl-N-dodecylamino)-toluene, 2-amino-5-(N-ethyl-N-β-methanesulfonamidoethyl)aminotoluenesulfate, 4-(N-ethyl-N-β-methanesulfonamidoethylamino)aniline, 4-(N-ethyl-N-β-hydroxyethylamino)aniline and 2-amino-5-(N-ethyl-β-methoxyethyl)aminotoluene. These color developing agents may be used either alone or in combination. If necessary, they may be used in combination with a black-and-white developing agent such as hydroquinone. The color developer usually contains an alkali agent such as sodium hydroxide, ammonium hydroxide, sodium carbonate or sodium sulfite, and other additives such as an alkali metal halide (e.g. potassium bromide) and a development regulator (e.g. hydrazinic acid).

The color developing agent shown above that is present in a hydrophilic colloidal layer in the silver halide photographic material of the present invention may be incorporated as a precursor. The precursor is a compound that is capable of forming a color developing agent under alkaline conditions, and illustrative examples include a Schiff base with an aromatic aldehyde derivative, polyvalent metal ion complex, phthalylimide derivative, phosphorylamide derivative, sugar-amine reaction product, and urethane. More specific examples of the precursors for aromatic primary amine color developing agents are shown in U.S. Pat. Nos. 3,342,599, 2,507,114, 2,695,234, 3,719,492, British Patent No. 803,783, Japanese Unexamined Published Patent Application Nos. 135,628/1978, 79,035/1979, as well as Research Disclosure Nos. 15,159, 12,146 and 13,924.

Such aromatic primary amine color developing agents or precursors therefor must be incorporated in amounts sufficient to provide adequate color formation during development. While the exact amount varies with the specific type of the photographic material to be processed, 0.1–5 moles, preferably 0.5–3 moles, of the color developing agent or its precursor are incorporated per mol of silver halide. The color developing agents and precursors therefor shown above may be used either alone or in combination. The compounds listed above may be incorporated in a photographic material after they are dissolved in a suitable solvent such as water, methanol, ethanol or acetone. Alternatively, a high-boiling organic solvent such as dibutyl phthalate, dioctyl phthalate or tricresyl phosphate may be used to form an emulsion of the compound, which is then incorporated in the photographic material. If desired, a latex polymer impregnated with the compound may be incorporated as shown in Research Disclosure No. 14850.

After color development, the silver halide color photographic material of the present invention is usually bleached, fixed (sometimes bleach-fixed in a single step) and rinsed with water. While many compounds are used as bleaching agents, compounds of polyvalent metals such as iron (III), cobalt (III) and tin (II) are preferred. Particularly suitable compounds are complex salts of such polyvalent cationic metals and organic acids, such as metal complex salts with aminopolycarboxylic acids (e.g. ethylenediaminetetraacetic acid, nitrilotriacetic acid, and Nhydroxyethylethylenediamine diacetic acid), malonic acid, tartaric acid, malic acid, diglycolic acid and dithioglycolic acid, as well as ferricyanate and bichromate salts. These compounds may be used either alone or in suitable combinations.

The silver halide photographic material of the present invention is characterized by the good solubility, dispersability and dispersion stability of the cyan couplers of the present invention incorporated in the silver halide emulsion layers; therefore, this photographic material is free from such defects as precipitation of the cyan couplers in the emulsion. Additionally, these cyan couplers have good spectral absorption characteristics and sufficient good color tone to provide sharp colored dye images over a broad color reproduction range. These couplers provide cyan dye image having peak absorption wavelengths at 645–655 nm and have an extremely small absorption in the ranges of 400–450 nm, 450–480 nm and 500–550 nm. Therefore, the couplers do not interfere with the intended reproduction of blue and green colors and ensure a very high level of brightness. The dye images produced by these couplers have good storage stability because they are highly resistant to light, heat and moisture. As a further advantage, the emulsion coating solution containing these cyan couplers has a sufficient long-term stability to enable the production of silver halide photographic materials of consistent quality.

The following Examples are provided for further illustrations of the present invention.

EXAMPLE 1

The cyan couplers of the present invention indicated in Table 1 and the comparative couplers C-1, -2 and -3 shown below were tested. Ten grams of each coupler was added to a mixture of dibutyl phthalate (5 ml) and ethyl acetate (30 ml), and the resulting mixture was heated to 60° C. so as to obtain a complete solution. This solution was mixed with 5 ml of a 10% aqueous solution of Alkanol XC (the trade name of Du Pont for sodium alkylnaphthalenesulfonate) and 200 ml of a 5% aqueous solution of gelatin. The mixture was emulsified with an ultrasonic homogenizer to prepare a dispersion of each coupler. The coupler dispersion was added to 500 g of an emulsion of silver chlorobromide (containing 80 mol% of silver bromide) and spread onto a polyethylene-coated paper support, followed by drying. In this manner, sixteen monochromatic photographic element samples No. 1 to No. 16 were prepared. After subjecting these samples to wedge exposure by a conventional method, they were processed by the following scheme.

| Processing scheme | Temperature (°C.) | Duration |
|---|---|---|
| Color development | 30 | 3 min and 30 sec |
| Bleach-fixing (Blix) | 30 | 1 min and 30 sec |
| Rinsing | 30 | 2 min |

The color developer and blix solution used had the following compositions.

| Components | Amount (g) |
|---|---|
| Color developer | |
| 4-Amino-3-methyl-N—ethyl-N—(β-methanesulfonamidoethyl)-aniline sulfate salt | 5 g |
| Benzyl alcohol | 15 ml |
| Sodium hexametaphosphate | 2.5 g |
| Anhydrous sodium sulfite | 1.85 g |
| Sodium bromide | 1.4 g |
| Potassium bromide | 0.5 g |
| Borax | 39.1 g |
| Water to make | 1,000 ml |
| pH adjusted to 10.3 with sodium hydroxide. | |
| Blix solution | |
| Ethylenediaminetetraacetic acid iron ammonium salt | 61.0 |
| Ethylenediaminetetraacetic acid diammonium salt | 5.0 |
| Sodium thiosulfate | 124.5 |
| Sodium metabisulfite | 13.5 |
| Anhydrous sodium sulfite | 2.7 |
| Water to make | 1,000 ml |

Each of the processed samples was checked for its spectral reflection characteristics and the stability of the dye image by the following procedures.

Spectral reflection test (i) Maximum reflection wavelength (λmax): The wavelength for a peak reflection density was measured with a Hitachi Color Analyzer Model 607 (product of Hitachi, Ltd.).

(ii) Reflection density (D): The reflection densities at wavelengths (λ) of 550, 470 and 420 nm were measured for a maximum density of 2.0 by the same color analyzer as used in (i).

(iii) Brightness (L*): Measured in accordance with JIS Z 8729-1980.

Image stability test (iv) Light fastness

Each of the dye images having an initial density of 1.0 was checked for the residual density after exposure to a xenon Fadeometer (45,000 lux) for 150 hrs.

(v) Dark discoloration

The residual density of a sample having an initial density of 1.0 was measured after storage in a dark place at 77° C. for 2 weeks.

The results of each of the test runs are summarized in Table 1.

Comparative coupler C-1:

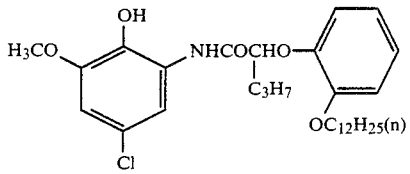

Comparative coupler C-2:

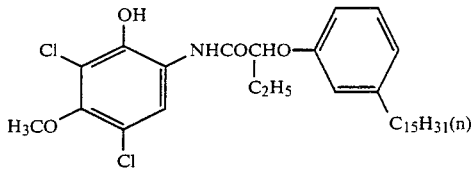

Comparative coupler C-3:

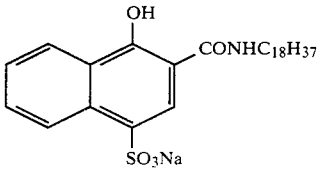

tion had smaller amounts of undesired absorption at 550 nm and 420 nm and lower minimum reflection densities than the comparative samples using only the compound of formula (I) as a cyan coupler. Therefore, the samples in accordance with the present invention produced brighter colored dye images having good spectral reflection characteristics. It is quite surprising that the combination of the cyan couplers of (I) and (II) provided such synergistic effects. The dye images resulting from such combination had quite satisfactory characteristics in terms of light fastness and dark discoloration.

EXAMPLE 2

The cyan couplers of the present invention indicated in Table 1 and the comparative couplers C-1, C-2 and C-3 were tested. Each coupler was added in an amount of 0.1 mol to a mixture of dibutyl phthalate (20 ml) and varying amounts of ethyl acetate, and the resulting mixture was heated at 60° C. The amount of the ethyl acetate that was necessary to dissolve the coupler was measured, and the results are shown in Table 2. The coupler solution thus prepared was mixed with aqueous solutions of Alkanol XC and gelatin which were the same as used in Example 1. The mixture was emulsified with an ultrasonic homogenizer to prepare a coupler dispersion. Each of the thus prepared coupler dispersions was added to 1,000 ml of a red-sensitive silver chlorobromide emulsion (with 30 mol% silver bromide) that contained photographic additives such as a hardener and an extender. Three samples were prepared for each of the silver halide emulsion coating solutions; one sample was immediately applied onto a polyethylene coated paper support; another sample was applied after standing at 40° C. for 3 hrs; and the third sample was applied after standing at 40° C. for 6 hours. Each web was dried to prepare a silver halide photographic material.

The samples were subjected to wedge exposure, processed in accordance with the scheme described in Example 1 and dried. They were then subjected to sensitometry with a Sakura Color Densitometer Model PDA-60 (product of Konishiroku Photo Industry Co., Ltd.) and their sensitivities are shown in Table 2 in terms of relative values, with the value for the samples prepared by applying the emulsion coating solutions

TABLE 1

| Sample No. | Cyan coupler composition: Cyan coupler of formula (I) (mol %) | Cyan coupler of formula (II) (mol %) | Comparative cyan coupler (mol %) | λ max (nm) | Spectral reflection density (D) λ = 550 | λ = 470 | λ = 420 | Brightness L* | Dye image stability: Light fastness | Dark discoloration | Remarks |
|---|---|---|---|---|---|---|---|---|---|---|---|
| 1 | I-1, 100 | — | — | 651 | 1.14 | 0.39 | 0.74 | 41.5 | 0.45 | 0.97 | Comparative sample |
| 2 | I-1, 80 | II-3, 20 | — | 650 | 1.03 | 0.28 | 0.76 | 43.5 | 0.77 | 0.97 | Sample of present invention |
| 3 | I-1, 60 | II-3, 40 | — | 650 | 1.00 | 0.28 | 0.78 | 44.4 | 0.86 | 0.96 | Sample of present invention |
| 4 | I-1, 80 | II-1, 20 | — | 650 | 1.02 | 0.29 | 0.78 | 43.5 | 0.80 | 0.98 | Sample of present invention |
| 5 | I-8, 100 | — | — | 655 | 1.13 | 0.38 | 0.77 | 38.9 | 0.40 | 0.97 | Comparative sample |
| 6 | I-8, 80 | II-3, 20 | — | 653 | 1.01 | 0.32 | 0.78 | 41.8 | 0.78 | 0.96 | Sample of present invention |
| 7 | I-15, 100 | — | — | 653 | 1.14 | 0.38 | 0.74 | 37.8 | 0.50 | 0.98 | Comparative sample |
| 8 | I-15, 60 | II-3, 40 | — | 652 | 1.04 | 0.31 | 0.77 | 42.1 | 0.87 | 0.96 | Sample of present invention |
| 9 | — | II-3, 100 | — | 650, | 1.04 | 0.29 | 0.92 | 44.9 | 0.89 | 0.64 | Comparative sample |
| 10 | — | II-1, 100 | — | 650 | 1.04 | 0.28 | 0.93 | 45.0 | 0.89 | 0.63 | Comparative sample |
| 11 | — | — | C-1, 100 | 648 | 1.05 | 0.33 | 0.95 | 38.7 | 0.71 | 0.64 | Comparative sample |
| 12 | I-1, 60 | — | C-1, 40 | 649 | 1.07 | 0.33 | 0.97 | 38.5 | 0.72 | 0.87 | Comparative sample |
| 13 | — | — | C-2, 100 | 644 | 1.12 | 0.34 | 0.95 | 37.2 | 0.73 | 0.58 | Comparative sample |
| 14 | I-1, 60 | — | C-2, 40 | 648 | 1.08 | 0.34 | 0.94 | 37.6 | 0.73 | 0.86 | Comparative sample |
| 15 | — | — | C-3, 100 | 700 | 0.90 | 0.31 | 0.88 | 39.4 | 0.42 | 0.81 | Comparative sample |
| 16 | I-1, 60 | — | C-3, 40 | 667 | 1.03 | 0.33 | 0.86 | 39.5 | 0.50 | 0.87 | Comparative sample |

As Table 1 shows, the samples of silver halide photographic material in accordance with the present invenimmediately after their preparation being taken as 100.

TABLE 2

| Sample No. | Cyan coupler composition: Cyan coupler of formula (I) (mol %) | Cyan coupler of formula (II) (mol %) | Comparative cyan coupler (mol %) | Emulsion coating solution stability (Relative sensitivity): As applied immediately after preparation | 3 hrs. | 6 hrs. | Remarks |
|---|---|---|---|---|---|---|---|
| 17 | I-1, 100 | — | — | 100 | 77 | 53 | Comparative sample |
| 18 | I-1, 80 | II-3, 20 | — | 100 | 95 | 90 | Sample of present invention |
| 19 | I-1, 60 | II-3, 40 | — | 100 | 97 | 95 | Sample of present invention |
| 20 | I-1, 80 | II-1, 20 | — | 100 | 93 | 87 | Sample of present invention |
| 21 | I-8, 100 | — | — | 100 | 78 | 55 | Comparative sample |
| 22 | I-8, 80 | II-3, 20 | — | 100 | 92 | 88 | Sample of present invention |
| 23 | I-15, 100 | — | — | 100 | 75 | 52 | Comparative sample |
| 24 | I-15, 60 | II-3, 40 | — | 100 | 98 | 97 | Sample of present invention |
| 25 | — | II-3, 100 | — | 100 | 97 | 95 | Comparative sample |
| 26 | — | II-1, 100 | — | 100 | 97 | 95 | Comparative sample |
| 27 | — | — | C-1, 100 | 100 | 92 | 88 | Comparative sample |
| 28 | I-1, 60 | — | C-1, 40 | 100 | 86 | 71 | Comparative sample |
| 29 | — | — | C-2, 100 | 100 | 90 | 82 | Comparative sample |
| 30 | I-1, 60 | — | C-2, 40 | 100 | 84 | 67 | Comparative sample |

As is clear from Table 2, the silver halide emulsion coating solutions containing the cyan couplers in accordance with the present invention were stable in that they could be left to stand for an extended period with minimum decrease in their sensitivities. On the other hand, the silver halide emulsion coating solutions containing the cyan couplers outside the scope of the present invention were unstable and suffered a considerable decrease in sensitivity upon standing. It is therefore concluded that the silver halide photographic material of the present invention retains consistently the same quality.

EXAMPLE 3

Multi-colored photographic elements were prepared by coating the following layers in the order written onto a polyethylene coated paper support.

First layer:

Blue-sensitive silver chlorobromide emulsion (with 90 mol % silver bromide) containing 300 g of gelatin per mol of silver halide, as well as 0.5 mol per mol of silver halide of yellow coupler YC-1 indicated below and dispersed in dibutyl phthalate was coated to give a gelatin deposit of 2 g/m$^2$, and dried).

Second layer:

The first intermediate layer (i.e. gelatin layer with a gelatin deposit of 1.5 g/m$^2$).

Third layer:

Green-sensitive silver chlorobromide emulsion (with 80 mol% silver bromide) containing 400 g of gelatin per mol of silver halide, as well as 0.3 mol of silver halide of magenta coupler MC-1 indicated below and dispersed in dibutyl phthalate was coated to give a gelatin deposit of 2 g/m$^2$, and dried.

Fourth layer:

The second intermediate layer containing ultraviolet absorber UV-1 indicated below and dispersed in 20 g of dibutyl phthalate was coated to give a UV absorber deposit of 0.6 g/m$^2$ and a gelatin deposit of 1.5 g/m$^2$, and dried.

Fifth layer:

Red-sensitive silver chlorobromide emulsion (with 80 mol% silver bromide) containing 300 g of gelatin per mol of silver halide, as well as 0.4 mol per mol of silver halide of a cyan coupler dispersed in dibutyl phthalate was coated to give a gelatin deposit of 20 g/m$^2$, and dried. The cyan coupler was comprised of both the cyan couplers of formula (I) and (II) in accordance with the present invention as indicated in Table 3, or of only the couplers of formula (I) shown in Table 3, or was comprised of the comparative cyan coupler C-1 or C-2 used either alone or in combination with the cyan couplers of formula (I). In Table 3, the proportions of the respective cyan couplers relative to the total amount of the cyan couplers used are indicated in mol%.

Sixth layer:

Protective layer (i.e. gelatin layer with a gelatin deposit of 1.5 g/m$^2$).

Samples 31 to 46 thus prepared were exposed to blue, green and red lights through optical wedges in a sensitometer (Model KS-7 of Konishiroku Photo Industry Co., Ltd.) and subsequently processed by the following scheme.

Scheme (32.8° C.)

| Steps | Duration |
|---|---|
| Color development | 3 min and 30 sec |
| Bleach-fixing | 1 min and 30 sec |
| Rinsing | 3 min and 30 sec |
| Drying | |

Color developer formulation

| Components | Amount |
|---|---|
| Sulfate salt of N—ethyl-N—β-methanesulfonamidoethyl-3-methyl-4-aminoaniline | 4.0 g |
| Hydroxylamine sulfate | 2.0 g |
| Potassium carbonate | 25.0 g |
| Sodium chloride | 0.1 g |
| Sodium bromide | 0.2 g |
| Anhydrous sodium sulfite | 2.0 g |
| Benzyl alcohol | 10.0 ml |
| Polyethylene glycol (average degree of polymerization: 400) | 3.0 ml |
| Water to make | 1,000 ml |
| pH adjusted to 10.0 with sodium hydroxide. | |

Bleach-fixing solution

| Components | Amount (g) |
|---|---|
| Ethylenediaminetetraacetic acid ammonium salt | 60.0 |
| Ammonium thiosulfate | 100.0 |
| Sodium bisulfate | 20.0 |
| Sodium metabisulfate | 5.0 |
| Water to make | 1,000 ml |
| pH adjusted to 7.0 with sulfuric acid. | |

YC-1

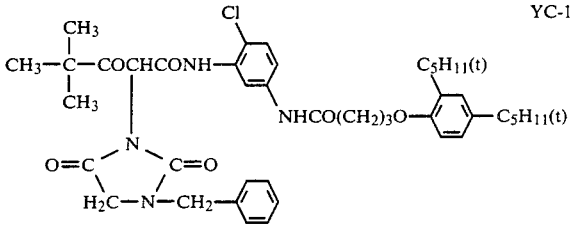

MC-1

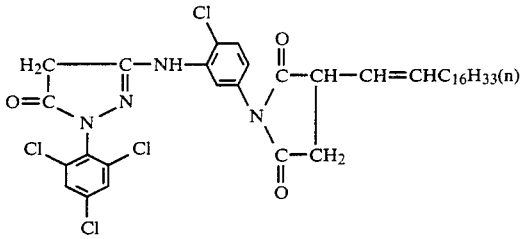

UV-1

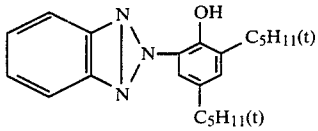

The processed samples were subjected to the following tests for evaluation of the color reproduction regions and the keeping quality of dye images.

Evaluation of color reproduction regions

In accordance with the color specification method using the L*u*v* system shown in JIS Z 8729-1980, a u'-v' chromaticity diagrams for L*=50 was prepared, and the color reproduction regions formed by yellow, magenta and cyan color forming dyes were evaluated by their relative areas (as overall values). The blue reproduction region (as formed by cyan and magenta color forming dyes), the green reproduction region (as formed by cyan and yellow color forming dyes) and the red reproduction region (as formed by magenta and yellow color forming dyes) were evaluated in terms of their relative areas.

Image stability test

The yellow (Y), magenta (M) and cyan (C) colored dye images were checked for their light fastness and dark discoloration by the same method as used in Example 1.

Emulsion coating solution stability test

The first through sixth layers mentioned above were coated onto a polyethylene-coated paper support, with the emulsion coating solutions being applied either immediately after their preparation or following standing at 40° C. for 5 hrs. The webs were dried and subjected to a stability test as in Example 2.

The results of the tests shown above are summarized in Table 3.

TABLE 3

| Sample No. | Cyan coupler composition: Cyan coupler of formula (I) (mol %) | Cyan coupler of formula (II) (mol %) | Comparative cyan coupler (mol %) | Color reproduction: Overall | Blue | Green | Red | Light discoloration: C | M | Y | Dark discoloration: C | M | Y | Emulsion coating solution stability (Relative sensitivity): Red-sensitive emulsion | Green-sensitive emulsion | Blue-sensitive emulsion | Remarks |
|---|---|---|---|---|---|---|---|---|---|---|---|---|---|---|---|---|---|
| 31 | I-1, 100 | — | — | 100 | 121 | 84 | 100 | 0.48 | 0.88 | 0.87 | 0.99 | 0.99 | 0.97 | 62 | 97 | 98 | Comparative sample |
| 32 | I-1, 80 | II-3, 20 | — | 111 | 120 | 98 | 100 | 0.87 | 0.89 | 0.88 | 0.98 | 0.98 | 0.97 | 96 | 98 | 99 | Sample of present invention |
| 33 | I-1, 60 | II-3, 40 | — | 113 | 120 | 99 | 100 | 0.89 | 0.89 | 0.88 | 0.96 | 0.98 | 0.98 | 97 | 98 | 99 | Sample of present invention |
| 34 | I-1, 80 | II-1, 20 | — | 110 | 120 | 98 | 100 | 0.87 | 0.89 | 0.87 | 0.98 | 0.99 | 0.97 | 96 | 97 | 98 | Sample of present invention |
| 35 | I-8, 100 | — | — | 95 | 118 | 83 | 100 | 0.40 | 0.88 | 0.87 | 0.99 | 0.98 | 0.98 | 64 | 98 | 98 | Comparative sample |
| 36 | I-8, 80 | II-3, 20 | — | 109 | 117 | 99 | 100 | 0.80 | 0.90 | 0.88 | 0.97 | 0.98 | 0.98 | 95 | 98 | 98 | Sample of present invention |
| 37 | I-15, 100 | — | — | 98 | 120 | 86 | 100 | 0.45 | 0.89 | 0.89 | 0.98 | 0.98 | 0.97 | 61 | 98 | 97 | Comparative sample |
| 38 | I-15, 60 | II-3, 40 | — | 110 | 119 | 99 | 100 | 0.87 | 0.89 | 0.89 | 0.96 | 0.99 | 0.97 | 98 | 98 | 98 | Sample of present invention |
| 39 | — | II-3, 100 | — | 100 | 100 | 100 | 100 | 0.90 | 0.91 | 0.88 | 0.64 | 0.98 | 0.97 | 98 | 98 | 98 | Comparative sample |
| 40 | — | II-1, 100 | — | 100 | 100 | 100 | 100 | 0.90 | 0.90 | 0.88 | 0.65 | 0.98 | 0.97 | 97 | 97 | 97 | Comparative sample |
| 41 | — | — | C-1, 100 | 92 | 95 | 91 | 100 | 0.71 | 0.88 | 0.88 | 0.62 | 0.99 | 0.99 | 89 | 97 | 98 | Comparative sample |
| 42 | I-1, 60 | — | C-1, 40 | 93 | 97 | 87 | 100 | 0.71 | 0.88 | 0.88 | 0.84 | 0.98 | 0.97 | 77 | 97 | 97 | Comparative sample |
| 43 | — | — | C-2, 100 | 90 | 95 | 90 | 100 | 0.74 | 0.88 | 0.89 | 0.60 | 0.98 | 0.98 | 85 | 98 | 98 | Comparative sample |
| 44 | I-1, 60 | — | C-2, 40 | 92 | 98 | 86 | 100 | 0.73 | 0.88 | 0.89 | 0.86 | 0.99 | 0.98 | 70 | 97 | 98 | Comparative sample |
| 45 | — | — | C-3, 100 | 91 | 96 | 91 | 100 | 0.44 | 0.85 | 0.88 | 0.81 | 0.99 | 0.98 | 86 | 97 | 98 | Comparative sample |
| 46 | I-1, 60 | — | C-3, 40 | 93 | 103 | 84 | 100 | 0.52 | 0.86 | 0.87 | 0.88 | 0.99 | 0.98 | 75 | 97 | 98 | Comparative sample |

As the data in Table 3 show, the multi-colored photographic elements using the cyan couplers in accordance with the present invention achieved an improved blue color reproduction without sacrificing the reproduction of a green color, thereby producing sharp dye images over a broad color reproduction range. Additionally, these elements exhibited an improvement in the overall image keeping quality by providing a good balance in the discoloration of cyan, magenta and yellow dyes. A further advantage resulted from the fact that the silver halide emulsion coating solutions containing the cyan couplers in accordance with the present invention were stable and suffered from a very small decrease in their sensitivities even when they were left to stand for a prolonged period after their preparation.

EXAMPLE 4

Multi-colored photographic elements were prepared as in Example 3 except that the cyan couplers in accordance with the present invention were replaced by those indicated in Table 4, and comparative couplers YC-1 and MC-1, as well as the ultraviolet absorber UV-1 by YC-2, MC-2 and UV-2 which are indicated below. The respective samples were subjected to the same tests as conducted in Example 3.

The test results are shown in Table 4.

YC-2

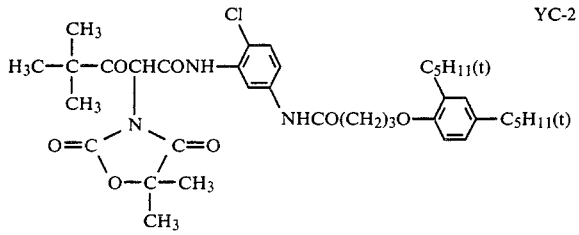

MC-2

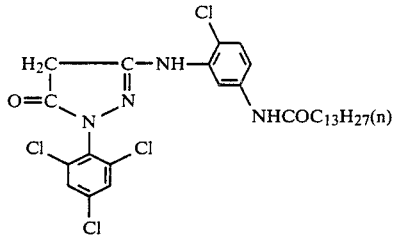

UV-2

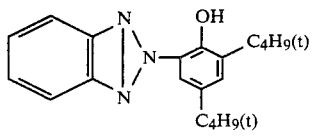

TABLE 4

| Sample No. | Cyan coupler composition: Cyan coupler of formula (I) (mol %) | Cyan coupler of formula (II) (mol %) | Comparative cyan coupler (mol %) | Color reproduction: Overall | Blue | Green | Red |
|---|---|---|---|---|---|---|---|
| 47 | I-19, 100 | — | — | 107 | 122 | 86 | 100 |
| 48 | I-20, 100 | — | — | 106 | 121 | 87 | 100 |
| 49 | I-22, 100 | — | — | 107 | 122 | 88 | 100 |
| 50 | I-25, 100 | — | — | 107 | 122 | 87 | 100 |
| 51 | I-27, 100 | — | — | 106 | 121 | 88 | 100 |
| 52 | I-19, 70 | II-4, 30 | — | 116 | 120 | 97 | 100 |
| 53 | I-20, 70 | " 30 | — | 115 | 120 | 98 | 100 |
| 54 | I-22, 70 | " 30 | — | 116 | 121 | 97 | 100 |
| 55 | I-25, 70 | " 30 | — | 115 | 129 | 98 | 100 |
| 56 | I-27, 70 | " 30 | — | 115 | 120 | 98 | 100 |
| 57 | — | — | C-1, 100 | 92 | 95 | 91 | 100 |

| Sample No. | Light discoloration: C | M | Y | Dark discoloration: C | M | Y | Emulsion coating solution stability (Relative sensitivity): Red-sensitive emulsion | Green-sensitive emulsion | Blue-sensitive emulsion | Remarks |
|---|---|---|---|---|---|---|---|---|---|---|
| 47 | 0.65 | 0.88 | 0.87 | 0.98 | 0.98 | 0.99 | 64 | 97 | 97 | Comparative sample |
| 48 | 0.64 | 0.87 | 0.87 | 0.99 | 0.98 | 0.98 | 64 | 96 | 97 | Comparative sample |
| 49 | 0.67 | 0.87 | 0.86 | 0.98 | 0.98 | 0.97 | 66 | 96 | 98 | Comparative sample |
| 50 | 0.64 | 0.88 | 0.87 | 0.98 | 0.97 | 0.97 | 65 | 97 | 98 | Comparative sample |
| 51 | 0.65 | 0.86 | 0.88 | 0.98 | 0.97 | 0.98 | 65 | 98 | 98 | Comparative sample |
| 52 | 0.87 | 0.88 | 0.88 | 0.97 | 0.97 | 0.98 | 97 | 98 | 98 | Sample of present invention |
| 53 | 0.88 | 0.87 | 0.88 | 0.97 | 0.97 | 0.98 | 97 | 97 | 97 | Sample of present invention |
| 54 | 0.87 | 0.87 | 0.87 | 0.98 | 0.98 | 0.97 | 98 | 98 | 98 | Sample of present invention |
| 55 | 0.87 | 0.88 | 0.87 | 0.97 | 0.98 | 0.98 | 98 | 98 | 98 | Sample of present invention |
| 56 | 0.88 | 0.88 | 0.87 | 0.97 | 0.97 | 0.98 | 97 | 98 | 98 | Sample of present invention |

TABLE 4-continued

| | | | | | | | | | | |
|---|---|---|---|---|---|---|---|---|---|---|
| 57 | 0.87 | 0.88 | 0.87 | 0.64 | 0.97 | 0.98 | 88 | 98 | 97 | Comparative sample |

As is shown in Table 4, the multi-colored photographic elements using the cyan couplers in accordance with the present invention achieved an improved reproduction of green and blue colors, especially a blue color, as in Example 3, thereby producing sharp dye images over a broad color reproduction range. Additionally, these elements exhibited an improvement in the overall image keeping quality by providing a good balance in the discoloration of cyan, magenta and yellow dyes. A further advantage resulted from the fact that the silver halide emulsion coating solutions containing the cyan couplers in accordance with the present invention were stable and suffered from a very small decrease in their sensitivities even when they were left to stand for a prolonged period after their preparation. It was therefore possible to provide silver halide photographic materials of consistent quality.

What is claimed is:

1. A silver halide photographic material having one or more silver halide emulsion layers formed on a support, at least one of said silver halide emulsion layers containing a cyan coupler of formula (I) in combination with a cyan coupler of formula (II):

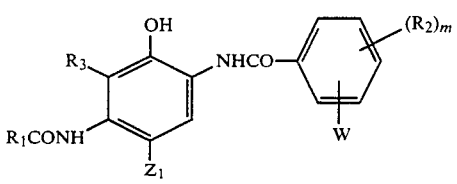

(I)

(wherein $R_1$ is a ballast group; $R_2$ is a halogen atom or a monovalent organic group; $R_3$ is a hydrogen atom, a halogen atom, an alkyl group or an alkoxy group; W is an alkyl-sulfonamido group, an arylsulfonamido group, an alkylsulfamoyl group or an arylsulfamoyl group; m is an integer of 0 to 4, provided that when m is 2 or more, $R_2$ may be the same or different; and $Z_1$ is a hydrogen atom or a group capable of leaving upon reaction with the oxidized product of an aromatic primary amine color developing agent);

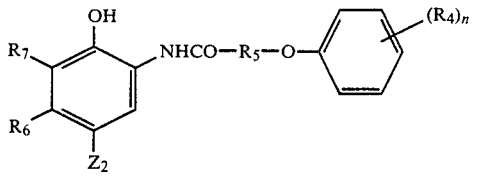

(II)

(wherein $R_4$ is an alkyl or alkoxy group; n is an integer of 0 to 5, provided that when n is 2 or more, $R_4$ may be the same or different; $R_5$ is an alkylene group; $R_6$ is an alkyl group; $R_7$ is a hydrogen atom, a halogen atom or an alkyl group; and $Z_2$ is a hydrogen atom or a group capable of leaving upon reaction with the oxidized product of an aromatic primary amine color developing agent).

2. A silver halide photographic material according to claim 1, wherein said cyan coupler of formula (I) is a compound represented by the following formula (III):

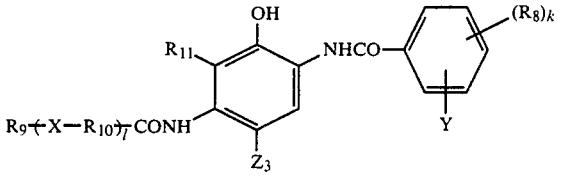

(III)

[wherein $R_8$ is a halogen atom, an alkyl group having 1 to 22 carbon atoms, a polyfluoroalkyl group or an alkoxy group; k is an integer of 0 to 4, provided that when k is 2 or more, $R_8$ may be the same or different; $R_9$ is an alkyl group or an aryl group; $R_{10}$ is an alkylene group; $R_1$ is a hydrogen atom or a halogen atom; X is a divalent group; Y is a group represented by

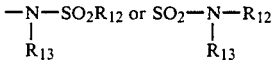

(wherein $R_{12}$ is an alkyl group or an aryl group; and $R_{13}$ is a hydrogen atom, an alkyl group or an aryl group); $Z_3$ is a hydrogen atom or a group capable of leaving upon reaction with the oxidized product of an aromatic primary amine color developing agent; and l is 0 or a positive integer.]

3. A silver halide photographic material according to claim 2, wherein l in said formula (III) is 1.

4. A silver halide photographic material according to claim 2, wherein $Z_3$ in said formula (III) is a hydrogen atom.

5. A silver halide photographic material according to claim 2, wherein $Z_3$ in said formula (III) is a halogen atom.

6. A silver halide photographic material according to claim 2, wherein Y in said formula (III) is substituted at the ortho- or para- position of the benzen ring with respect to —NHCO—bonded to the benzen ring.

7. A silver halide photographic material according to claim 6, wherein Y in said formula (III) is substituted at the ortho- position of the benzen ring with respect to —NHCO—bonded to the benzen ring.

8. A silver halide photographic material according to claim 1, wherein said cyan coupler of formula (I) is incorporated in an amount of 30 to 95 mol% to the total amount of cyan couplers.

* * * * *